United States Patent [19]

Johnson, Jr. et al.

[11] Patent Number: 4,531,110

[45] Date of Patent: Jul. 23, 1985

[54] NEGATIVE TEMPERATURE COEFFICIENT THERMISTORS

[75] Inventors: David W. Johnson, Jr., Pluckemin; Murray Robbins, Berkeley Heights, both of N.J.

[73] Assignee: AT&T Bell Laboratories, Murray Hill, N.J.

[21] Appl. No.: 301,721

[22] Filed: Sep. 14, 1981

[51] Int. Cl.[3] ..... H01C 7/04

[52] U.S. Cl. ..... 338/22 R; 29/612; 252/518; 252/519; 252/520; 252/521

[58] Field of Search ..... 338/22 R, 22 SD; 29/612; 252/518, 519, 520, 521

[56] References Cited

U.S. PATENT DOCUMENTS 3,124,772 3/1964 Newkirk ..... 338/22 R
3,510,820 5/1970 Jonker et al. ..... 338/22 R
3,622,901 11/1971 Ledran et al. ..... 338/22 SD X
3,795,048 3/1974 Tachibana et al. ..... 338/22 R X
3,928,837 12/1975 Esper et al. ..... 338/22 R

FOREIGN PATENT DOCUMENTS 0072158 6/1978 Japan ..... 338/22 R

OTHER PUBLICATIONS

Herbert B. Sachse, Semiconducting Temperature Sensors and their Applications, 1975, pp. 59–87.

*Primary Examiner*—C. L. Albritton
*Attorney, Agent, or Firm*—Kenneth H. Samples

[57] ABSTRACT

Inexpensive Mn or Mg ferrites may be used as negative temperature coefficient thermistors. Fabrication of devices with the desired high temperature coefficients is facilitated by a processing method which forms a thin layer of oxidized and high resistivity material on a low resistivity layer of ferrite material.

13 Claims, 7 Drawing Figures

NEGATIVE TEMPERATURE COEFFICIENT THERMISTORS

TECHNICAL FIELD

This invention relates generally to thermally sensitive resistors, commonly referred to as thermistors, and particularly to such resistors having negative temperature coefficients.

BACKGROUND OF THE INVENTION

Thermistors are devices having a temperature varying electrical resistance. If the resistance decreases with increasing temperature, the devices are generally referred to as negative temperature coefficient (NTC) thermistors. These devices, i.e., NTC thermistors, are widely used for temperature measurement as well as for temperature control and compensation of other circuit elements which have positive temperature coefficients of resistivity. Many types of materials, for example, oxides and semiconductors, are used in thermistors and are useful in resistance measuring devices at temperatures as low as, for example, liquid helium temperatures, and as high as, for example, 1600 degrees K.

While many characteristics of thermistors are of interest, one principal device characteristic of interest is the room temperature resistance. This resistance may range from several ohms to several megohms. Both the device geometry and thermistor material characteristics affect the resistance. The resistivity versus temperature behavior for negative temperature thermistors generally follows an exponential relationship over a wide range of temperatures, that is, $\rho = A \exp(\beta/T)$ where $\rho$ is the resistivity at temperature T, A is a constant over the temperature range of interest and $\beta$ is the temperature coefficient. Knowledge of the room temperature resistivity and thus, the resistance, and the value of $\beta$ permits calculation of the device resistance at any temperature within a specified temperature range. A high value of $\beta$, for a given resistance, is generally desirable as it provides a resistance that changes rapidly with temperature.

Other device characteristics may be important for some applications. For example, if joule heating of the thermistor is utilized, specification of the heat dissipation rate will be necessary. The heat dissipation rate, generally specified as the number of milliwatts required to raise the thermistor temperature by 1 degree C., depends upon the device geometry and may be varied by changing the device geometry. Additionally, a thermal time constant which specifies the response time of a thermistor to a change in temperature may be important for some applications. The thermal time constant depends on the thermal mass of the device.

Many, if not most, negative temperature coefficient thermistors are fabricated from the oxides of transition metals such as manganese, nickel and cobalt. See, for example, *Semiconducting Temperature Sensors and Their Applications*, pp. 59–87, Herbert B. Sachse, John Wiley and Sons, New York, 1975. The increasing cost of some transition metals, especially cobalt, makes alternative and lower cost materials desirable. Cobalt lacking ferrites, such as $ZnFe_2O_4$, have been investigated for use in negative temperature coefficient thermistors but such ferrites tend to have $\beta$ values that are significantly, and undesirably, lower than the $\beta$ values of thermistors based on the NiMnCo system for the desired device resistances. As a result, the latter system has been more widely used commercially. Even for the cobalt based system, however, higher $\beta$ values would be desirable for some purposes.

Negative temperature coefficient thermistors are generally formed by mixing, calcining and ball milling oxides or carbonates of the transition metals to form a powder suitable for fabrication into thermistors. Fabrication may be done by dry pressing as well as other techniques that use a slurry of the powder. For all fabrication methods, however, the materials are sintered to their final form.

SUMMARY OF THE INVENTION

We have found that thermistors having desirable characteristics, such as the temperature coefficient, may be fabricated from a composition consisting essentially of Mn-Mg ferrites. The thermistor comprises a first layer of material with the nominal atom composition $M_{1-x}R_zFe_{2+x-z}O_4$ and electrical contacts on opposed faces of said thermistor. M comprises at least one element selected from the group consisting of Mn and Mg and is substituted for Fe atoms in amounts such that x is less than or equal to 0.30. Higher values of x may yield undesirably low values for the resistivity. R comprises other elements, such as Al or Ti, which are substituted for Fe atoms with z less than or equal to approximately 1.2. R need not be present, i.e., z may equal 0.0.

The material may be fabricated either by the conventional ferrite processing scheme, that is, mixing, filtering, drying, calcining, milling, forming and sintering, which produces essentially homogeneous properties. Another technique produces nonhomogeneous, i.e., nonuniform, properties, which results in a higher temperature coefficient. The latter technique facilitates use of low resistivity thermistor material as a first layer in devices by forming a thin second layer of oxidized and high-resistivity ferrite over the first layer of low resistivity ferrite. The high resistivity layer is formed by heat treating the ferrite material of said first layer for a short time in an oxidizing atmosphere. The thin high resistivity layers are disposed intermediate said first layer and said electrical contacts. This technique may be used with Zn, Co, Ni and Cu containing ferrites, i.e., M is at least one element selected from the group consisting of Mn, Mg, Zn, Co, Ni and Cu. The overall device resistance remains low while the desired temperature characteristics are obtained.

DETAILED DESCRIPTION

Figure 1:
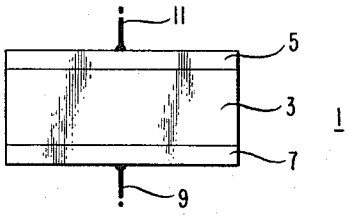
FIG. 1 is a sectional view of a thermistor of this invention.

A sectional view of one embodiment of a thermistor 1 of this invention is shown in FIG. 1. For reasons of clarity, the elements of the thermistor are not drawn to scale. Thermistor 1 comprises layers 3, 5 and 7 and electrical contacts 9 and 11 made to layers 7 and 5, respectively. Layer 3 consists essentially of ferrite material having the nominal atom composition $M_{1-x}R_zFe_{2+x-z}O_4$. M comprises at least one element selected from the group consisting of Mn, Mg, Zn, Co, Ni and Cu, and x is less than or equal to 0.30. R comprises at least one element selected from the group consisting of Al and Ti, and z is less than or equal to approximately 1.2. R is not necessarily present, i.e., z may equal 0.0. It is contemplated that small amounts of other materials, such as a binder or impurities, may be present in amounts less than 1 weight percent, after sintering, without deviating from this invention. It is to be understood that although described with respect to a nominal atom composition, either an oxygen excess or deficiency with respect to the nominal composition may be present.

In the embodiment depicted, layer 3 comprises low resistivity ferrite material of nominal composition $M_{1-x}R_zFe_{2+x-2}O_4$ where the $Fe^{2+}$ content is approximately x, and layers 5 and 7 comprise high resistivity ferrite material which is formed by oxidizing a surface layer of the low resistivity ferrite material. That is, the layers 5 and 7 have the nominal composition $M_{1-x}R_zFe_{2+x-z}O_{4+\beta}$ where $\beta$ is greater than 0.0 and less than approximately 0.2. If $z=0.0$, $\beta$ is greater than 0.0 and less than or equal to x/2, i.e., most of the $Fe^{2+}$ is oxidized to $Fe^{3+}$. This embodiment leads to a higher temperature coefficient material and an increase in the apparent device resistivity. Although described in terms of two layers, it is to be understood that the oxidized material may cover all of the unoxidized material, i.e., the oxidized material may be thought of as forming a single layer.

It is also contemplated that layers 5 and 7 may not be present. In this embodiment, M is at least one element selected from the group consisting of Mn and Mg. Electrical contacts 9 and 11 are then made directly to layer 3.

Electrical contacts 9 and 11 are formed on opposed surfaces of the thermistor using ultrasonically soldered In electrodes. Other electrode configurations such as fired silver pastes may also be used.

Exemplary methods for forming the thermistor material will be discussed and then material compositions and their relationship to device properties will be further discussed. An exemplary method of forming the layers 5 and 7 which gives to these layers a high resistivity and a high temperature coefficient will also be discussed.

Typical starting materials are reagent grade oxides and carbonates, for example, $Fe_2O_3$, $MnCO_3$, $MgCO_3$, $Al_2O_3$ and $TiO_2$. The materials are mixed in water, filtered, dried, and calcined at a temperature of 900 degrees C. for a time of approximately 16 hours. The calcined powder is then ball milled for approximately 16 hours in steel mills with steel balls as a slurry in $CCl_4$ to which approximately 10 percent, by weight, of a binder has been added. The milled slurry is then dried while stirring and the resulting powder is granulated through a screen such as an 18 mesh screen. The calcined material may also be milled in $H_2O$ using water soluble additives and then dried in a spray drier to give a pressing powder. Pellets, approximately 1.25 cm in diameter, are then pressed from this powder. The pellets are fired by first heating slowly, for over a time of approximately 16 hours, to 600 degrees C. to remove the binder and then heating at 400 degrees C./hour to the sintering temperature.

Times and temperatures may be varied in a well-known manner. However, some variations of firing temperatures, times and atmospheres that were not previously known and lead to desirable thermistor characteristics, e.g., a higher temperature coefficient resulting from a thin oxidized layer, will be discussed in detail later.

The materials may be fired under two sets of conditions. The first, referred to as conventional firing, describes heat treatments where the desire is to sinter the ferrite powder to produce a material having homogeneous electrical properties. The second, which is new with one aspect of our invention, describes heat treatments where the desire is production of thermistors having nonhomogeneous i.e., nonuniform, electrical properties through the body. This method, for a given apparent resistivity, yields a large increase in the temperature coefficient.

For conventional firing, the thermistor materials were fired for approximately two hours at a temperature between 1250 and 1350 degrees C. in a $O_2$-$N_2$ atmosphere which may range from essentially pure nitrogen, approximately only 10 ppm $O_2$, to pure oxygen. The equilibrium oxidation state of iron depends upon both the temperature and oxygen partial pressure in the atmosphere and as a result, the thermistor materials were cooled by reducing the oxygen content of the atmosphere while cooling in a manner designed to maintain a uniform oxygen content throughout the body.

For many applications, materials having a typical temperature coefficient of 3000 to 4000 and a room temperature resistivity significantly lower than $10^4$ ohm cm are desirable. A method of obtaining higher values of $\beta$ for a given value of resistivity will be described.

The circuit designer who uses thermistors is not generally concerned with the material property, resistivity, but only in the device property which is resistance. This concern may be understood from the following hypothetical example: a disc whose faces have a circular cross sectional area of approximately 1 $cm^2$ on which electrodes are placed and a thickness of 2 mm is a shape appropriate for many device applications. Assuming that the material has a room temperature resistivity of 500 ohm cm, the device resistance will be approximately 100 ohms. However, if a material having the same temperature coefficient were available but with a room temperature resistivity two orders of magnitude greater, the device resistance would be the same if the thickness were reduced by two orders of magnitude. However, this will result in a disc only 20 $\mu$m thick. This thickness is undesirable because of the difficulty involved in manufacturing and handling such thin parts using conventional technology. The parts would be very fragile and the differences in dimensions between this and/or conventional configurations would lead to sharply different heat dissipation and thermal response characteristics which might require significant device redesign.

These disadvantages may be overcome if the firing procedure is modified to produce a thin, highly resistive layer. This may be done with ferrite compositions by firing the ferrite at approximately 1350 degrees C. in $N_2$ and then reheating the ferrite in an oxidizing atmosphere at a temperature of at least 900 degrees C. In this way, the initial impervious material having a room temperature resistivity less than 10 ohm-cm acquires a thin, high room temperature resistivity layer by oxidation of the surface. As indicated by the discussion of the relationship between resistivity and $\beta$, this high resistivity layer will have a high temperature coefficient. The unoxidized material then serves primarily as a relatively low resistivity substrate for the thin highly resistive layer which effectively controls the electrical resistance characteristics of the device.

To obtain a thin layer of oxidized ferrite, the thermistor materials were first fired at 1350 degrees C. in $N_2$ and then heat treated for short times at high temperatures in a more oxidizing atmosphere. Air is conveniently used, although an atmosphere having an oxygen content between 1 percent and 100 percent could be used. The oxidation time is sufficiently short to prevent the oxidized layer from becoming undesirably thick and sufficiently long to obtain the desired device resistivity. The oxidized layer is desirably less than 100 $\mu$m thick to prevent device resistivity from becoming too great. If the layer is too thin, the device resistivity is too low.

Different methods may be used to produce the oxidized layer. One oxidizing method involves reheating the material at 400 degrees per hour to temperatures in the range of 1000 degrees C. and immediately cooling the furnace. Another oxidizing method involves rapidly pushing the materials into a preheated furnace and rapidly withdrawing them after several minutes. However, this method may present difficulty with cracked samples due to thermal shock.

The most desirable oxidizing method from the viewpoint of device properties and ease of operation is pulling a ceramic, for example, $Al_2O_3$, boat loaded with at least one thermistor device through a heated tube furnace at a constant rate using, for example, a motor drive. With such a method, an array of thermistors may be prepared simultaneously. The degree of oxidation is controlled by the furnace temperature, the furnace atmosphere and the pulling rate, i.e., the time in the furnace. The time and temperature may be reduced as the oxygen content increases. As the temperature is reduced, the time will increase. The oxidizing temperature should be kept below the sintering temperature.

Device characteristics were determined as follows. The thermistors were held between spring clips which made electrical contact with the In electrodes while the electrical measurements which will be discussed with respect to FIGS. 2–7 were made. The resulting assembly was held at the desired and variable temperatures in a thermostatically-controlled bath. Sufficient current from a constant current source was passed through the samples to dissipate approximately 0.01 to approximately 1 mW of power at 0 degrees C. Higher currents were not used because it had been determined that significant joule heating did not occur until more than 1 mW W as dissipated. The temperature coefficient, $\beta$, was calculated from 0 and 50 degrees C. resistance measurements. The 25 degree C. measurement of resistivity is, by convention, referred to as the room temperature resistivity.

Figure 2:
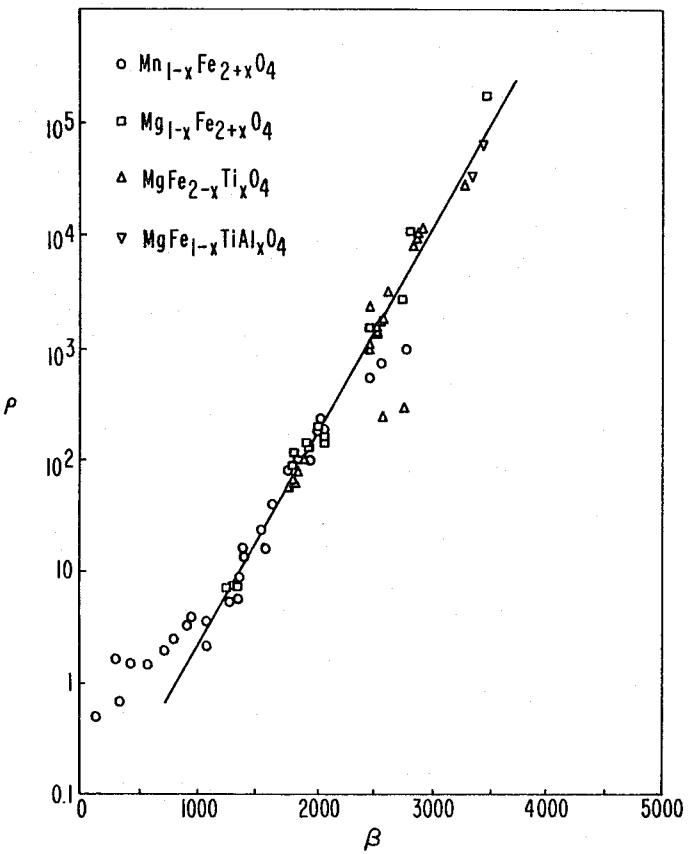
FIG. 2 plots the temperature coefficient, $\beta$, horizontally, versus the apparent room temperature resistivity, vertically, for Mn and Mg ferrite thermistors.

Material compositions and their relationship to device properties will be discussed by reference to FIGS. 2–7. FIG. 2 plots the temperature coefficient, horizontally, versus the room temperature resistivity, vertically, in units of ohm cm for several thermistor compositions. The circles represent $Mn_{1-x}Fe_{2+x}O_4$, the squares represent $Mg_{1-x}Fe_{2+x}O_4$, the upright triangles represent $MgFe_{2-x}Ti_xO_4$ and the inverted triangles represent $MgFe_{1-x}TiAl_xO_4$. For the four groups of compositions, x varied between 0.0125 and 0.2, 0.0125 and 0.05, 0.0 and 1.0, and 0.0 and 0.2, respectively. The data illustrate that there is a general linear relationship between the logarithm of the room temperature resistivity and $\beta$. This relationship is explained qualitatively by recognizing that ferrites conduct electrons because of the multiple oxidation states of the cations and especially the Fe cation. Within the band model, the $Fe^{2+}$ ion introduces localized energy levels into the bandgap and because the number of these localized energy levels increases with increasing $Fe^{2+}$ concentrations, the gap between these levels and the conduction band decreases. The result is a lower activation energy for conduction. Thus, an increasing $Fe^{2+}$ concentration results in a lower resistivity because of an increase in the number of carriers and a decreased activation energy for conduction. The temperature coefficient, $\beta$, is proportional to this activation energy.

Several means of control over the resistivity and temperature coefficient are available for the materials whose properties are plotted in FIG. 2. The first involves compositional control. The Mn and Mg ferrites are iron excess ferrites where the excess Fe is available for incorporation into the spinel lattice as $Fe^{2+}$. Similarly, the substitution of $Ti^{4+}$ for $Fe^{3+}$ in $MgFe_2O_4$ leads to incorporation of $Fe^{2+}$ for charge compensation. Furthermore, the incorporation of $Al^{3+}$ for $Fe^{2+}$ in $MgFeTiO_4$ reduced some $Ti^{4+}$ to $Ti^{3+}$ although these Al substituted compositions had high resistivities.

Figure 3:
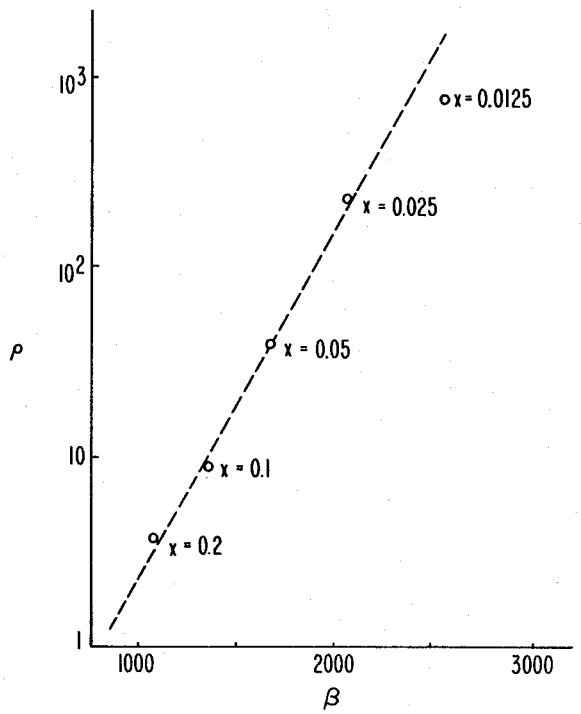
FIG. 3 plots temperature coefficient, horizontally, versus the room temperature resistivity, vertically, for Mn ferrite thermistors having varying Mn content and the nominal composition $Mn_{1-x}Fe_{2+x}O_4$.

FIG. 3 plots the room temperature coefficient, horizontally, versus room temperature resistivity in units of ohm cm, vertically, for an iron excess Mn ferrite fired at 1250 degrees C. for approximately 2 hours in air. The nominal composition was $Mn_{1-x}Fe_{2+x}O_4$ and devices were made with differing amounts, indicated as x in FIG. 2, of excess iron with x varying from 0.0125 to 0.2. As can be seen, the room temperature resistivity varies by more than two orders of magnitude for the range of compositions depicted. Compositions with a value of x greater than approximately 0.3 are undesirable because of the low resistivity caused by the presence of too much $Fe^{2+}$. The dashed line is the line from FIG. 2 and indicates that these devices follow the general linear relationship between the logarithm of the room temperature resistivity and temperature coefficient.

Figure 4:
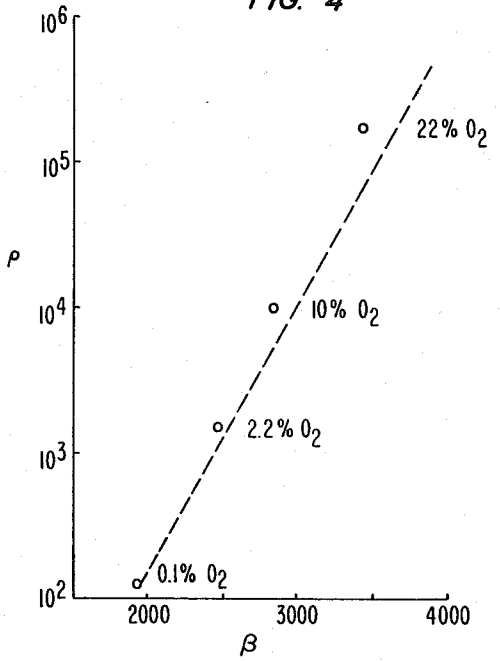
FIG. 4 plots the temperature coefficient, horizontally, versus the room temperature resistivity, vertically, for a Mg ferrite thermistor fired in atmospheres having differing oxidation oxygen contents.

Resistivity may also be controlled by using the firing atmosphere composition to modify the Fe oxidation state. For example, FIG. 4 plots the temperature coefficient, horizontally, versus the room temperature resistivity in units of ohm cm, vertically, for a $Mg_{0.9875}Fe_{2.0125}O_4$ thermistor fired in atmospheres having differing oxygen content. As can be seen, as the firing atmosphere oxygen content increases from 0.1 percent to 22 percent, the room temperature resistivity varies by approximately three orders of magnitude. Increasing oxygen content leads to a decrease in $Fe^{2+}$ content and an increase in resistivity. It is also apparent that there is again a general linear relationship between the logarithm of the room temperature resistivity and the temperature coefficient as indicated by the presence of the straight line from FIG. 2.

Figure 5:
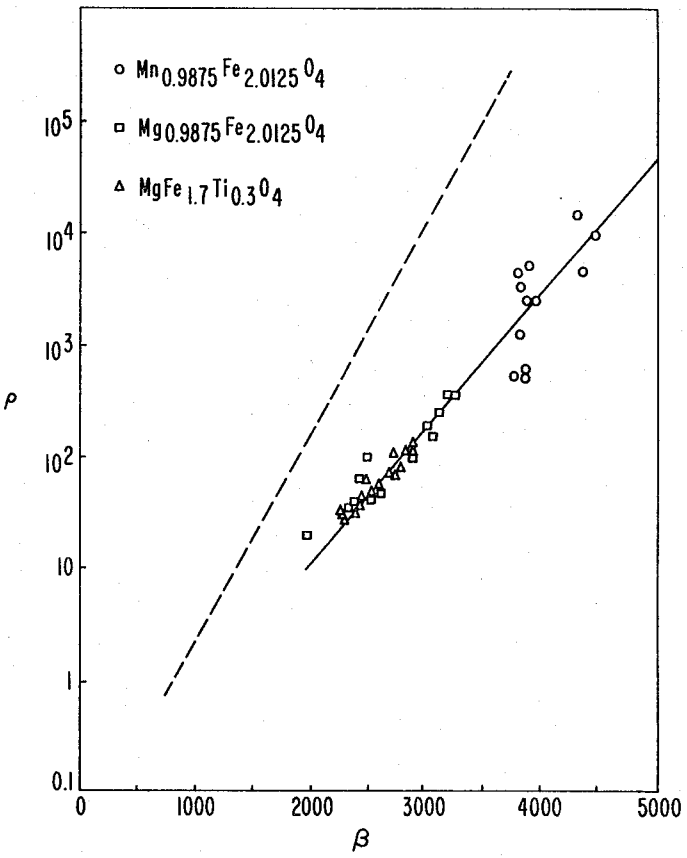
FIG. 5 plots the temperature coefficient, horizontally, versus the apparent room temperature resistivity, vertically, for thermistors having ferrites fired to give thin high resistivity layers.

FIG. 5 plots the temperature coefficient, horizontally, versus the apparent room temperature resistivity in units of ohm cm, vertically, for thermistors having thin oxidized surface layers. The circles, squares and triangles represent the compositions $Mn_{0.9875}Fe_{2.0125}O_4$, $Mg_{0.9875}Fe_{2.0125}O_4$ and $MgFe_{1.7}Ti_{0.3}O_4$, respectively. The dashed line represents the materials depicted and described with respect to FIG. 2. It is apparent that the oxidation step permits the temperature coefficient to be greatly increased without a corresponding increase in the apparent device resistivity. It should be noted that FIG. 5 shows the apparent resistivity as calculated from the sample dimensions and resistance. The apparent resistivity is plotted to avoid the implication that the material properties are homogeneous throughout the device. In fact, since the surface oxidized layer accounts for most of the thermistor resistance, the thermistor resistance is relatively insensitive to the thermistor thickness. Thus, the apparent resistivity of the thermistors will depend on device dimensions which, for the samples shown, were discs about 1 cm in diameter and about 2 mm thick.

Figure 6:
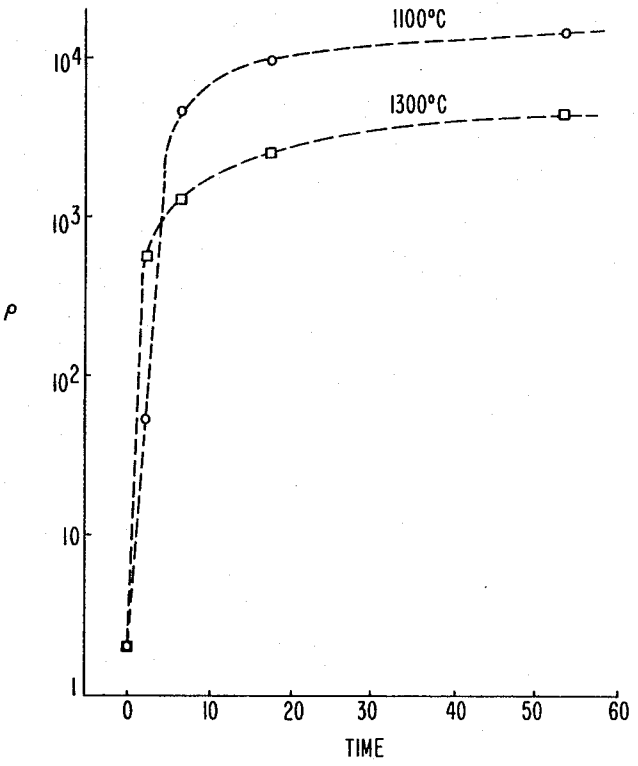
FIG. 6 plots the time at the oxidation temperature, horizontally, versus the apparent room temperature resistivity, vertically, for differing oxidation temperatures for two Mn ferrites.

The characteristics shown in FIG. 5 may be controlled by several methods. FIG. 6 shows the time at the oxidation temperature, horizontally, in minutes versus the apparent resistivity in units of ohm cm, vertically, for $Mn_{0.9875}Fe_{2.0125}O_4$ thermistors oxidized at two furnace temperatures. These curves demonstrate that the rate at which the devices are pulled through the hot furnace, i.e., the residence time, can be used to control the resistance or apparent resistivity of the device. FIG. 6 also demonstrates that the furnace temperature permits a degree of control over apparent resistivities. However, the material shown in FIG. 6 would not be ideal for controlling the apparent resistivity because the resistance of the samples changes, at least initially, very rapidly with time in the furnace and the values reached for long residence times may be undesirably high.

Figure 7:
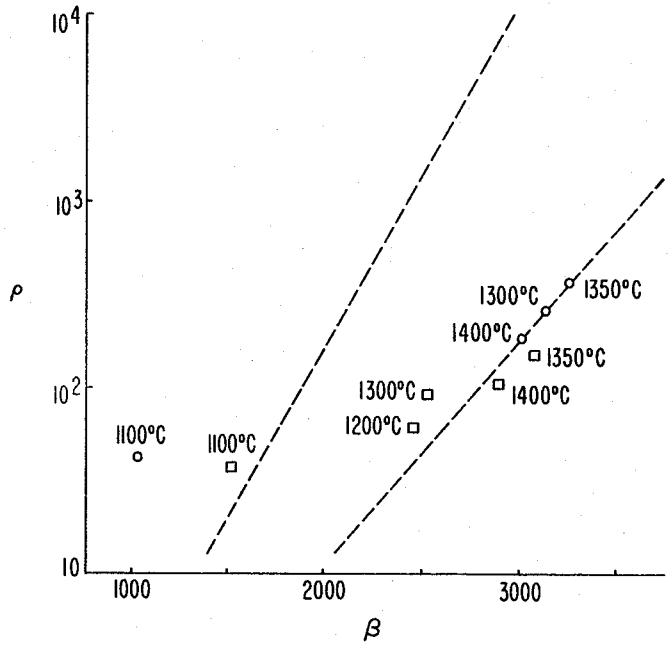
FIG. 7 plots the temperature coefficient, horizontally, versus the apparent room temperature resistivity, vertically, for differing oxidation times for a Mg ferrite.

The rapid oxidation characteristic of the Mn ferrites shown with respect to FIG. 6 may be avoided by using Mg ferrites having the composition $Mg_{0.9875}Fe_{2.0125}O_4$ as shown in FIG. 7. FIG. 7 plots the temperature coefficient, horizontally, versus the apparent resistivity, vertically, for oxidation residence times of 17 and 43 minutes as indicated by squares and circles, respectively, at the indicated temperatures. The dashed lines are those of FIGS. 2 and 5. It should be noted that at 1100 degrees C., very little oxidation takes place, and the properties are similar to the untreated samples depicted in FIG. 2. Within the temperature range between 1200 and 1400 degrees C., the oxidation results in properties similar to those of FIG. 5. The 43 minute residence time allows more oxidation and thus higher resistances than the 17 minute oxidation time.

Two other methods of controlling device characteristics exist. These are variations that are possible in the excess iron content of the ferrite and the effect of varying the furnace atmosphere during oxidation. The excess iron content control is appealing since the attainable values of apparent resistivity would probably be lower for the Mn ferrites shown in FIG. 6 if the excess iron content were higher. The argument has been made that the oxidation of ferrite takes place to give a uniform oxidized layer of some thickness. There will obviously be a gradient of oxygen content from highest at the sample surface to lowest at the sample center, according to the profile of oxygen diffusion. Furthermore, the likely enhanced diffusion along grain boundaries will lead to faster oxidation of material closest to the grain boundaries. In the extreme case of very rapid grain boundary diffusion and very slow bulk diffusion, the samples would have a macroscopically homogeneous oxygen content through the samples with microscopic gradients of oxygen away from the grain boundaries. This type of oxidation could give the properties shown with respect to FIG. 5, because there would be very many thin oxidized layers near the grain boundaries rather than layers only near the sample surfaces. However, it has been found that homogeneous oxidation along the grain boundaries does not actually occur. A sample of $Mn_{0.9875}Fe_{2.0125}O_4$ was oxidized to give an apparent resistivity 590 ohm-cm and a $\beta$ of 3880. Electrodes and about 20 $\mu$m of material were removed from each face of light grinding of this 2.2 mm thick sample. Electrodes were again formed on surfaces, and it was found that the sample resistance had dropped an order of magnitude. This indicates that much of the oxidized high resistivity material resides in the outer 20 $\mu$m of the disc.

What is claimed is:

1. A thermistor comprising a first layer of material having the nominal atom composition $M_{1-x}Fe_{2+x-z}R_zO_4$, where M is at least one element selected from the group consisting of Mn and Mg, x is greater than or equal to 0.0 and less than or equal to 0.3, R is selected from the group consisting of Al and Ti, z is greater than or equal to 0.0 and less than or equal to 1.2, and electrical contacts on opposed surfaces of said layer, and a second and a third layer of material having the composition $M_{1-x}Fe_{2+x-z}R_zO_{4+\beta}$, said $\beta$ being greater than 0.0 and less than 0.2, said layers being disposed intermediate said first layer and said electrical contacts.

2. A thermistor comprising a first layer of material having the nominal atom composition $M_{1-x}Fe_{2+x-z}R_zO_4$, where M is at least one element selected from the group consisting of Mn, Mg, Ni, Co, Cu and Zn, x is greater than or equal to 0.0 and less than or equal to 0.3, R is selected from the group consisting of Al and Ti, z is greater than or equal to 0.0 and less than or equal to 1.2, electrical contacts to opposed surfaces of said layer, a second and a third layer of material having the composition $M_{1-x}Fe_{2+x-z}R_zO_{4+\beta}$, said $\beta$ being greater than 0.0 and less than 0.2, said layers being disposed intermediate said first layer and said electrical contacts.

3. A thermistor as recited in claim 2 in which said second layer has a thickness less than 100 $\mu$m.

4. A thermistor as recited in claim 1 or 2 in which M is Mg.

5. A thermistor as recited in claim 4 in which x is less than or equal to.

6. A thermistor as recited in claim 5 in which R comprises Ti and z is less than or equal to 1.2.

7. A thermistor as recited in claim 6 in which R further comprises Al.

8. A thermistor as recited in claim 7 in which said R comprises $TiAl_y$, said y being greater than or equal to 0.0 and less than or equal to 0.2, said x being essentially 0.0.

9. A thermistor as recited in claim 5 in which z is essentially 0.0, and $\beta$ is greater than 0.0 and less than or equal to x/2.

10. A thermistor as recited in claim 9 in which x is between 0.0125 and 0.05.

11. A thermistor as recited in claim 1 or 2 in which M is Mn.

12. A thermistor as recited in claim 11 in which z is essentially 0.0 and $\beta$ is greater than 0.0 and less than or equal to x/2.

13. A thermistor as recited in claim 12 in which x is at least 0.0125 and less than or equal to approximately 0.2.

* * * * *